US005668497A

United States Patent [19]

Kang et al.

[11] Patent Number: 5,668,497

[45] Date of Patent: Sep. 16, 1997

[54] DIRECT-CURRENT VOLTAGE GENERATING CIRCUIT INTERMITTENTLY ACTIVATED FOR REDUCING ELECTRIC POWER CONSUMPTION

[75] Inventors: Bok-Moon Kang; Seung-Moon Yoo, both of Suwon, Rep. of Korea

[73] Assignee: Samsung Electronics Co., Ltd., Suwon, Rep. of Korea

[21] Appl. No.: 574,021

[22] Filed: Dec. 18, 1995

[30] Foreign Application Priority Data

Dec. 28, 1994 [KR] Rep. of Korea ..... 38084/1994

[51] Int. Cl.[6] ..... G05F 1/10

[52] U.S. Cl. ..... 327/544; 327/160; 327/530; 365/189.09; 365/227

[58] Field of Search ..... 327/160, 544, 327/530, 538; 365/189.09, 227, 226

[56] References Cited

U.S. PATENT DOCUMENTS 5,359,558 10/1994 Chang et al. ..... 365/189.09
5,365,487 11/1994 Patel et al. ..... 365/226
5,430,681 7/1995 Sugawara et al. ..... 365/227
5,440,259 8/1995 Yokomura ..... 327/160
5,459,435 10/1995 Taki ..... 327/160
5,521,952 5/1996 Morishima ..... 327/160

*Primary Examiner*—Timothy P. Callahan
*Assistant Examiner*—Jung Ho Kim
*Attorney, Agent, or Firm*—Allen LeRoy Limberg

[57] ABSTRACT

Disclosed is a DC voltage generating circuit for reducing an electric power consumption in a semiconductor memory device. The DC voltage generating circuit comprises: a refresh counter for setting a refresh cycle; a power source supply controller for logically combining a counting value supplied from the refresh counter and a self-refresh timer driving signal, thereby to generate a power source supply control signal in a refresh section; and a DC voltage generator for generating and supplying a DC voltage through an output terminal of the DC voltage generator, as controlled by the power source supply control signal supplied from the power source supply controller.

16 Claims, 3 Drawing Sheets

DIRECT-CURRENT VOLTAGE GENERATING CIRCUIT INTERMITTENTLY ACTIVATED FOR REDUCING ELECTRIC POWER CONSUMPTION

The present invention relates to a direct-current voltage generating circuit for a semiconductor memory device and, more particularly, to a direct-current voltage generating circuit that is selectively activated during a self-refresh mode, so as to reduce the electric power consumption in the semiconductor memory device.

BACKGROUND OF THE INVENTION

In general, the direct current (hereinafter, referred to as "DC") voltage generator is required to operate an internal circuit in a semiconductor memory device. Many kinds of the DC voltage generators have consumed a constant amount of DC power in order to maintain a DC voltage level set in accordance with each of objects thereof. The power consumption is also continued even in a stand-by state. Most of the power consumption of the self-refresh mode mainly occurs by a constant DC power continuously consumed during a very long stand-by state in the self-refresh mode that is carried on for data retention, when compared with a normal read/write operation.

In a conventional DC voltage generating circuit shown in FIG. 1, a bias voltage through resistors R1 and R2 drives an NMOS transistor NMOS1 and a PMOS transistor PMOS1, to generate the constant DC voltage supplied through an output terminal of the DC voltage generating circuit. However, much of the electric power consumption in the conventional DC voltage generating circuit is brought about by its being constructed to always generate the DC voltage irrespective of the stand-by state in the self-refresh mode.

SUMMARY OF THE INVENTION

An object of the present invention is to reduce this power consumption, which is done by selectively activating the DC voltage generating circuit. During a stand-by state of a self-refresh mode in a semiconductor memory device the DC voltage generating circuit is inactivated. To implement this desired operation the DC voltage generating circuit comprises: a refresh counter for defining a refresh cycle; a power source supply controller for logically combining a counting value supplied from the refresh counter with a self-refresh timer driving signal, thereby to generate the power source supply control signal in a cell refresh section; and a DC voltage generator for generating and supplying the DC voltage through an output terminal of the DC voltage generator, under control of the power source supply control signal supplied from the power source supply controller.

BRIEF DESCRIPTION OF THE DRAWING

The following is a detailed description of the invention by the reference of their attached drawing, in which like numbers indicate the same or similar elements.

DETAILED DESCRIPTION OF THE PREFERRED EMBODIMENT

Figure 2:
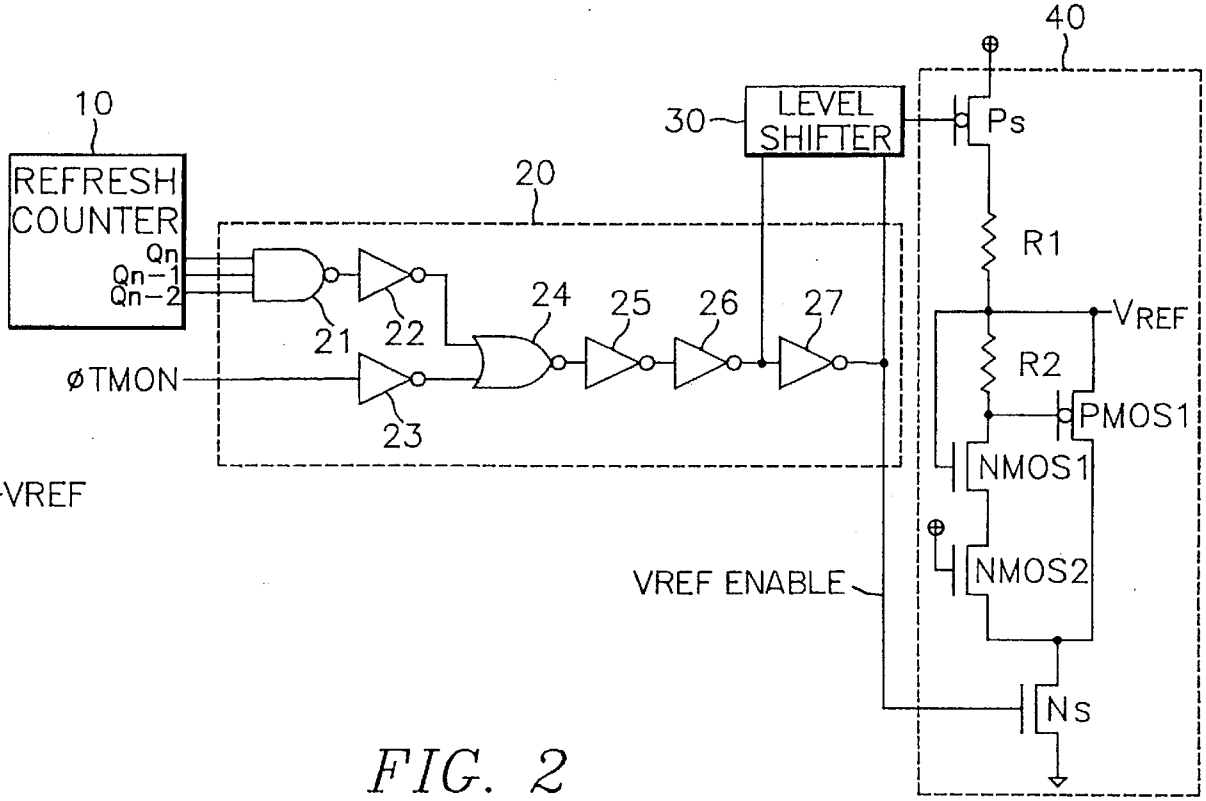
FIG. 2 is a circuit diagram illustrating a DC voltage generating circuit according to the present invention.
Figure 1:
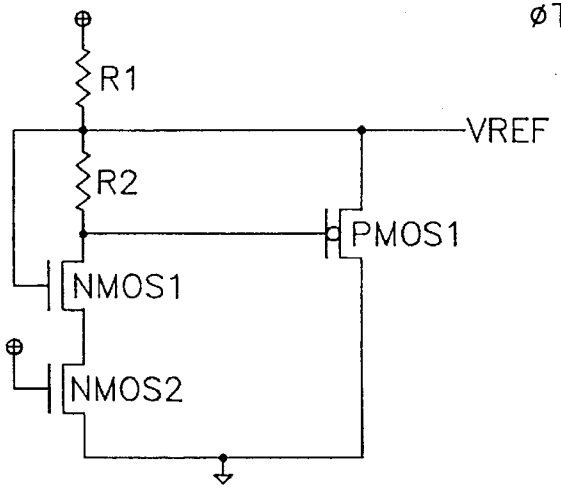
FIG. 1 (PRIOR ART)
FIG. 1 is a circuit diagram illustrating a conventional DC voltage generating circuit.

FIG. 2 is a circuit diagram illustrating a DC voltage generating circuit selectively activated, according to the invention, for reducing electric power consumption. The DC voltage generating circuit of FIG. 2 comprises: a refresh counter 10 for cyclically counting to define portions of a refresh cycle; a power source supply controller 20 for logically combining a count supplied from the refresh counter 10 with a self-refresh timer driving signal ϕTMON, thereby to generate the power source supply control signal in a refresh section; a level shifter 30 for controlling a level of the power source supply control signal supplied from the power source supply controller 20, and inputting the level controlled signal to a gate of a PMOS transistor Ps; and a DC voltage generator 40 for selectively generating and supplying a DC voltage through an output terminal thereofof the DC voltage generator 40, as controlled by the power source supply control signal supplied from the power source supply controller 20 and the complement of that signal supplied from the level shifter 30.

Figure 3:
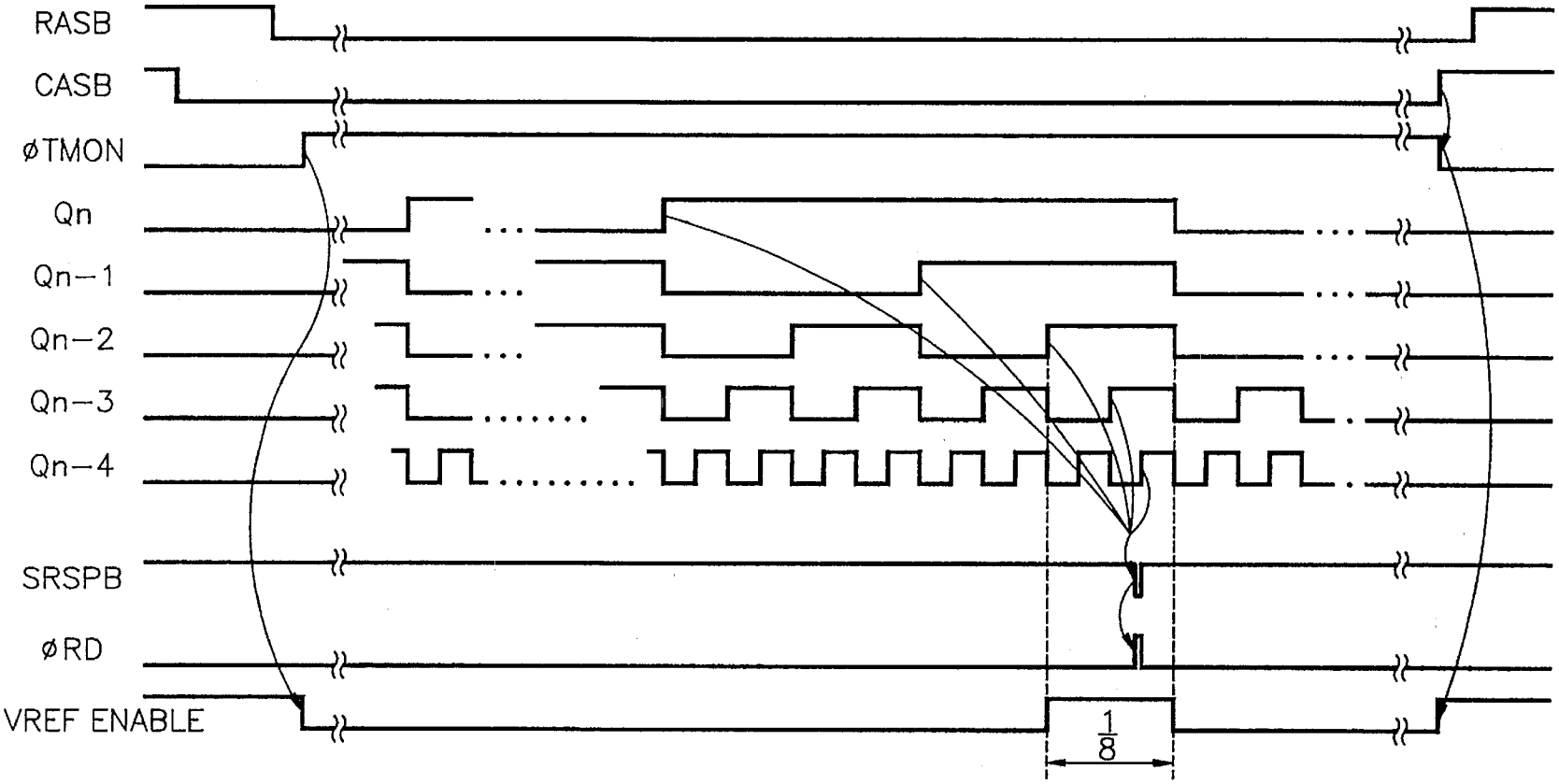
FIG. 3 is a timing diagram illustrating the operation in a self-refresh mode according to the present invention.

If a (Column Address Strobe) signal is generated and a (Row Address Strobe) signal is then generated, as shown in FIG. 3, thereby to enter a self-refresh mode with long CBR (CAS Before RAS refresh mode) cycle over 100 μs, a self-refresh start timer driving signal ϕTMON goes high, as shown in FIG. 3. When ϕTMON is high the refresh counter 10 is enabled to start counting from 0000. Thereafter, the refresh counter 10 supplies counting values $Q_n$, $Q_{n-1}$, $Q_{n-2}$, $Q_{n-3}$ and $Q_{n-4}$ as shown in FIG. 3 for defining the self-refresh period. The signals $Q_n$, $Q_{n-1}$ and $Q_{n-2}$ supplied from the refresh counter 10 are logically ANDed by supplying them to a NAND gate 21, the response of which NAND gate is complemented by an inverter 22 to generate an AND response that is ONE when a full 1111 count is decoded and is a ZERO for all other values of count. As will be described in detail, the DC voltage generator 40 is selectively enabled when the full 1111 count is decoded.

The self-refresh start timer driving signal ϕTMON is low, except when a self-refresh mode is entered. As will be described in detail, the DC voltage generator 40 is selectively enabled when the self-refresh start timer driving signal ϕTMON is low. The self-refresh start timer driving signal ϕTMON is supplied to an inverter 23 to be inverted to generate a first input signal for a NOR gate 24 receiving its second input signal from the inverter 22. The response of NOR gate 24 is delayed by cascaded inverters 25 and 26 for application to a further inverter 27 and to a level shifter 30. The response of the inverter 27 is a DC voltage enable signal, shown in FIG. 3 as VREF ENABLE, applied to the level shifter 30 and to a gate of an NMOS transistor Ns in the DC voltage generator 40. The level shifter 30 supplies the complement of this DC voltage enable signal, VREF ENABLE, to a gate of an PMOS transistor Ps in the DC voltage generator 40, responsive to push-pull input drive from the inverters 26 and 27.

The NMOS transistor Ns is switched into conduction responsive to the response VREF ENABLE of the inverter 27 going high. At the same time the PMOS transistor Ps is switched into conduction responsive to the response of the inverter 26 preceding the inverter 27 going low and to the response VREF ENABLE of the inverter 27 going high.

Accordingly, the DC voltage generator 40 is controlled, being activated only when VREF ENABLE of FIG. 3 is high within a cell refresh operation during the time that the semiconductor memory device is operated in self-refresh mode, thereby to reduce the power consumption. Therefore, excepting for a period in which the cell refresh enable signal ϕRD shown in FIG. 3 is enabled to carry out cell refresh operation among a $Q_n$ section as one period of a self-refresh, most of all $Q_n$ sections remain in a stand-by state in which the DC voltage generator 40 is not activated. The DC voltage generator 40 is activated only ⅛ of the as one period of the self-refresh mode among the $Q_n$ periods the rest of which are in the stand-by state, responsive to $Q_n$, $Q_{n-1}$ and $Q_{n-2}$ all being in the logic "high" states. At the time the DC voltage generator 40 is activated, the period during which the actual cell refresh operation takes place is about ¾ of the time the enabling voltage VREF ENABLE shown in FIG. 3 is generated.

Figure 4:
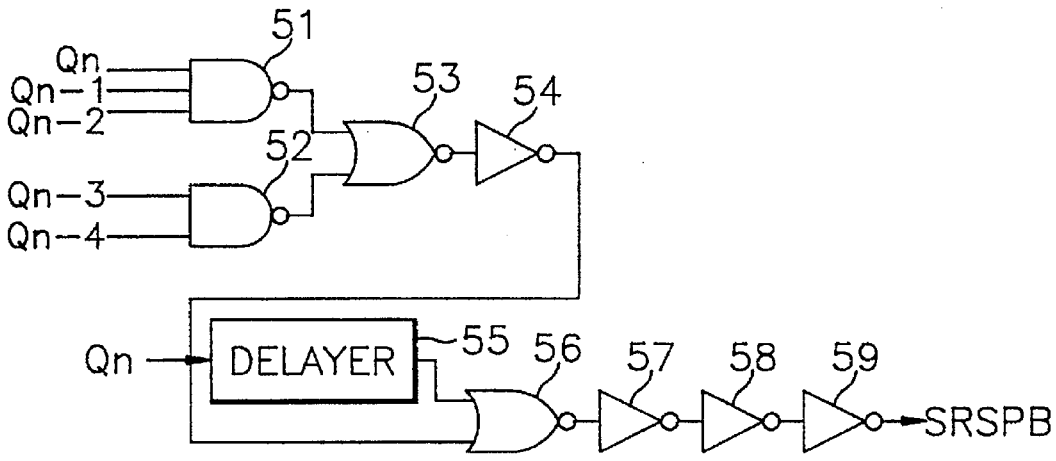
FIG. 4 is a circuit diagram illustrating the detector of detecting a cell refresh operation signal in the self-refresh mode according to the present invention.
Figure 5:
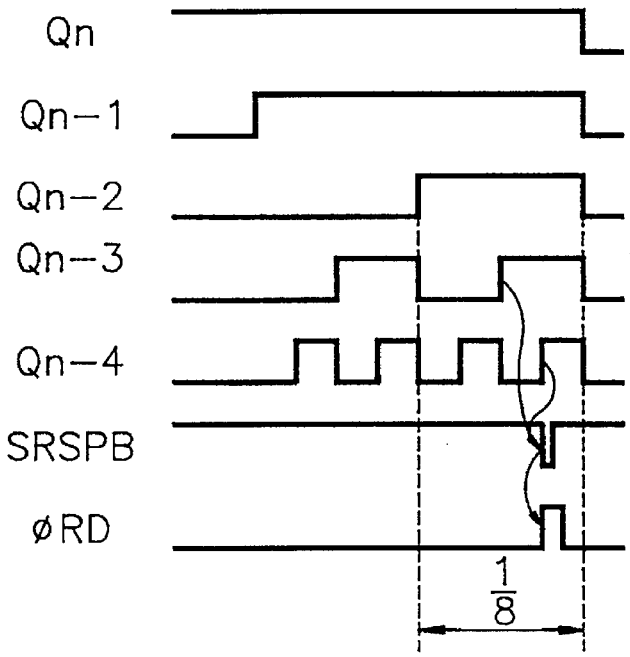
FIG. 5 is a timing diagram illustrating the operation for detecting the cell refresh operation signal according to the present invention.

The operation of generating the cell refresh enable signal ϕRD of FIG. 3 when performing the cell refresh operation will now be more particularly described with reference to FIG. 4. The signals $Q_n$, $Q_{n-1}$ and $Q_{n-2}$ as shown in FIG. 5, supplied from the refresh counter 10 are logically combined in an NAND gate 51 and are then supplied to a NOR gate 53. Also, the signals $Q_{n-3}$ and $Q_{n-4}$ shown in FIG. 5, supplied from the refresh counter 10 are logically combined in a NAND gate 52 and are then supplied to a NOR gate 53. The NOR gate 53 and the inverter 54 thereafter OR the signals respectively supplied from the NAND gate 51 and 52 for application to an input of a NOR gate 56. Another input of the NOR gate 56 receives $Q_n$ signal from the refresh counter 10 after a delayer 55 delays the $Q_n$ signal a prescribed period of time. The NOR gate 56 and the inverter 57 thereafter OR the delayed $Q_n$ signal from the delayer 55 with the OR response from the inverter 54, and the combined OR response as delayed by the cascaded inverters 58 and 59 to generate a signal SRSPB. If the SRSPB signal supplied from the inverter 59 in FIG. 5 is complemented, the cell refresh enable signal ϕRD shown in FIG. 5 is obtained. Accordingly, the cell refresh operation is performed in the final quarter of each time period during which the DC voltage generator 40 is activated, so the DC voltage generator 40 is fully set up. The DC voltage generator 40 continues to be activated in the remainder of this final quarter after the cell refresh operation, thereby to ensure a precharge operation after the cell refresh operation.

In the self-refresh mode of the semiconductor memory device, the DC voltage generator 40 is enabled only ⅛ of the time during cell refresh operation and is disabled the remaining ⅞ of the time during a stand-by operation. Accordingly, the power consumption in the DC voltage generator 40 is substantially reduced. A simulation result thereof is shown in the following Table 1.

TABLE 1

| | Prior Art | The present invention | |
|---|---|---|---|
| | | ¼ operation | ⅛ operation |
| C-$v_{REF}$ | 4.85 μA | 1.22 μA | 0.61 μA |
| $v_{REF}$ | 2.25 μA | 0.57 μA | 0.29 μA |
| STB-IVC | 5.2 μA | 1.30 μA | 0.65 μA |
| $v_{BB}$ | 2.1 μA | 0.56 μA | 0.30 μA |

Conditions: $v_{EXT}$ = 3.8 V, TEMP. = 83° C., and $v_{BB}$ = −1.7 V

While there have been illustrated and described what are considered to be preferred embodiments of the present invention, it will be understood by those skilled in the art that various changes and modifications may be made, and equivalents may be substituted for elements thereof without departing from the true scope of the present invention.

What is claimed is:

1. A direct current (DC) voltage generating circuit for reducing an electric power consumption in a semiconductor memory device, comprising:

refresh counter for timing a refresh cycle;

a power source supply controller for logically combining a counting value supplied from said refresh counter and a self-refresh timer driving signal, thereby to generate a power source supply control signal in a cell refresh section;

a DC voltage generator for generating and supplying a DC voltage through an output terminal thereof under the control of said power source supply control signal supplied from said power source supply controller; and a level converter for supplying the complement of said power source supply control signal to said DC voltage generator.

2. The DC voltage generating circuit as claimed in claim 1, wherein said power source supply control signal is periodically generated at a self-refresh mode.

3. A DC voltage generating circuit for reducing an electric power consumption in a semiconductor memory device, including a refresh counter for timing a refresh cycle, said DC voltage generating circuit comprising:

a power source supply controller for logically combining a counting value supplied from said refresh counter with a self-refresh timer driving signal, thereby to generate a power source supply control signal during a cell refresh period;

switching means for performing a switching operation in order to supply a power source voltage in correspondence with said power source supply control signal supplied from said power source supply controller; and DC voltage generation circuitry for generating a DC voltage responsive to said power source voltage supplied by the switching operation of said switching means.

4. The DC voltage generating circuit as claimed in claim 3, further comprising:

a level converter for supplying the complement of said power source supply control signal to said switching means.

5. The DC voltage generating circuit as claimed in claim 3, wherein said power source supply control signal is periodically generated at a self-refresh mode.

6. The DC voltage generating circuit as claimed in claim 5, wherein said power source supply control signal is enabled only in a cell refresh operation portion of each period of a self-refresh.

7. The DC voltage generating circuit as claimed in claim 6, wherein said switching means comprises a first switching means connected to a power source voltage terminal and a second switching means connected to a ground power source terminal.

8. The DC voltage generating circuit as claimed in claim 7, wherein said first switching means comprises a PMOS transistor.

9. The DC voltage generating circuit as claimed in claim 8, wherein said second switching means comprises a NMOS transistor.

10. The DC voltage generating circuit as claimed in claim 9, wherein said power source supply controller supplies first and second power source supply control signals being logical complements of each other.

11. The DC voltage generating circuit as claimed in claim 10, wherein said first power source supply control signal is applied to a gate of said PMOS transistor, and said second power source supply control signal is applied to a gate of said NMOS transistor.

12. The DC voltage generating circuit as claimed in claim 8, wherein said power source supply controller supplies first and second power source supply control signals being logical complements of each other.

13. The DC voltage generating circuit as claimed in claim 12, wherein said first power source supply control signal is applied to a gate of said PMOS transistor.

14. The DC voltage generating circuit as claimed in claim 7, wherein said second switching means comprises a NMOS transistor.

15. The DC voltage generating circuit as claimed in claim 14, wherein said power source supply controller supplies first and second power source supply control signals being logical complements of each other.

16. The DC voltage generating circuit as claimed in claim 15, wherein said second power source supply control signal is applied to a gate of said NMOS transistor.

* * * * *